US007967143B2

(12) United States Patent
Paliotta et al.

(10) Patent No.: US 7,967,143 B2
(45) Date of Patent: Jun. 28, 2011

(54) MULTI-LAYERED CHILD RESISTANT BLISTER PACKAGE

(75) Inventors: Michael Paliotta, Horseheads, NY (US); George Howell, Elmira, NY (US)

(73) Assignee: F.M. Howell & Company, Elmira, NY (US)

( * ) Notice: Subject to any disclaimer, the term of this patent is extended or adjusted under 35 U.S.C. 154(b) by 0 days.

(21) Appl. No.: 12/391,663

(22) Filed: Feb. 24, 2009

(65) Prior Publication Data

US 2010/0213097 A1 Aug. 26, 2010

(51) Int. Cl.
*B65D 85/42* (2006.01)

(52) U.S. Cl. ..... 206/531; 206/532; 206/462

(58) Field of Classification Search ..... 206/461, 206/462, 531, 534, 536, 538, 539, 581, 494, 206/478, 480, 440, 229, 210, 532; 221/25, 221/30, 31, 32

See application file for complete search history.

(56) References Cited

U.S. PATENT DOCUMENTS 3,759,371 A * 9/1973 Marks ..... 206/531
3,820,655 A * 6/1974 La Tourette et al. ..... 206/532
3,912,115 A * 10/1975 Smith ..... 220/277
4,074,806 A * 2/1978 Ardito ..... 206/531
4,537,312 A * 8/1985 Intini ..... 206/531
4,905,866 A * 3/1990 Bartell et al. ..... 221/5
4,988,004 A * 1/1991 Intini ..... 206/532
5,019,125 A * 5/1991 Rebne et al. ..... 206/532
5,339,960 A 8/1994 Price
5,469,968 A * 11/1995 Matthews et al. ..... 206/532
5,673,793 A * 10/1997 Seidler ..... 206/531
5,816,404 A * 10/1998 Seidler ..... 206/461
5,878,887 A * 3/1999 Parker et al. ..... 206/531
5,954,202 A * 9/1999 Mellon ..... 206/462
5,988,429 A * 11/1999 Coe ..... 221/25
6,024,222 A * 2/2000 Friberg et al. ..... 206/531
6,206,233 B1 * 3/2001 Schulze ..... 221/25
6,219,997 B1 * 4/2001 Friberg et al. ..... 53/453
6,641,031 B2 * 11/2003 Evans et al. ..... 206/532
6,854,618 B2 * 2/2005 Harrold ..... 221/25
6,951,282 B2 * 10/2005 Jones ..... 206/531
7,000,768 B2 2/2006 Morita et al.
7,000,769 B2 * 2/2006 Killinger ..... 206/534
7,025,207 B2 4/2006 Breu et al.
7,100,793 B2 * 9/2006 Baum ..... 221/15
7,175,044 B2 * 2/2007 Benktzon et al. ..... 221/25
7,252,208 B1 * 8/2007 Alvino et al. ..... 221/31
7,264,137 B2 * 9/2007 Drought et al. ..... 221/25
7,284,661 B1 * 10/2007 Evans et al. ..... 206/532

(Continued)

*Primary Examiner* — J. Gregory Pickett
*Assistant Examiner* — Kaushikkumar Desai
(74) *Attorney, Agent, or Firm* — Arent Fox LLP

(57) ABSTRACT

A multi-layered blister package includes a first panel having at least one first aperture defined therein, wherein a blister pocket is visible through the at least one first aperture and retains an article therein. A second panel has at least one exit aperture defined therein by a first non-continuous cut line, wherein the at least one exit aperture aligns with the at least one first aperture when the first panel is disposed over the second panel. A first fold line separates the first and second panels. A biasing force transmitting member is provided with the first panel, such that a biasing force is applied to the blister pocket via the biasing force transmitting member. The biasing force transmitting member includes at least one of a plurality of spring legs encompassing the at least one first aperture and a shield member disposed between the first panel and the blister pocket.

19 Claims, 7 Drawing Sheets

U.S. PATENT DOCUMENTS

| | | | | |
|---|---|---|---|---|
| 7,325,689 | B2 | 2/2008 | Buss | |
| 7,360,652 | B2 * | 4/2008 | Arnold | 206/538 |
| 2004/0178111 | A1 * | 9/2004 | Harrold | 206/532 |
| 2005/0077203 | A1 | 4/2005 | Morita et al. | |
| 2005/0173291 | A1 | 8/2005 | Specker et al. | |
| 2006/0231702 | A1 * | 10/2006 | Straus | 248/188.9 |
| 2007/0235367 | A1 | 10/2007 | Initini | |
| 2009/0107873 | A1 * | 4/2009 | Cotton et al. | 206/531 |

* cited by examiner

MULTI-LAYERED CHILD RESISTANT BLISTER PACKAGE

BACKGROUND OF THE INVENTION

1. Field of the Invention

This invention relates to a child-resistant blister package formed by a plurality of panels separated from each other by fold lines, with a first panel including a plurality of first apertures defined therein, the first apertures being disposed opposite corresponding second and third apertures, respectively, defined in neighboring second and third panels. More specifically, the invention relates to a package wherein the first apertures may be covered by a, preferably translucent, bias able material to restrict direct access to a blister contained in the package via the first apertures, wherein the biasable material and the radially extending channels or spokes extending from the first apertures, either together or alternatively alone or separately, assist a user in applying a substantially evenly distributed pressure to a blister for removal of a product from the package.

2. Description of Related Art

It is common practice to use blister packages to package small, solid articles or products which may be dispensed from the package by applying pressure to the blister to force the article or product from an individual blister or capsule through a rupturable membrane. Since this type of packaging is typically used for marketing medicines, the invention will be referred to herein with respect to a package particularly suitable for such use, but it should be understood that the package may be used for other products as well, such as food products, like candy, etc., or non-consumable articles, like batteries for hearing aides and the like. Recently, a substantial effort has been directed toward providing packaging that contains sufficient impediments to prevent children from easily opening the package and gaining access to the package articles or products while still providing adults with easy access to the articles or products contained therein.

For example, U.S. Pat. No. 5,954,202 to Mellon discloses a paperboard blank used for constructing a self-contained, re-closeable package (2) that includes a center panel (6) with a side panel (4) extending from a first side and side panels (8), (10) and (12) in series, extending from the opposing side. Upper and lower flaps (36 and 28) extend from the center panel (6). See FIG. 1. The center panel (6) includes perforated apertures (18) defined therein that receive the blister packs (54) in the side panel (12) and the side panel (10) includes perforated apertures (28) defined therein that receive blister packs (58) therein. Articles (52) and (56) are placed in the blister packs (54) and (58), respectively, such that when the side panels (10) and (12) are folded over the fold line (26), blister packs (54) and (58) are retained between panels (12) and (6), and (10) and (8), to keep the blister packs (54) and (58) in place. At the same time, apertures (24) defined in the side panel (8) receive the blisters (28) in the side panel (10). Side panel (8) is then folded over fold line (30) onto the back of the panel (12). Upper and lower panels (36 and 38) are then folded over the back of the panel (8). The side panel (4) is then folded over fold line (14) to form the fully assembled package (60). See FIGS. 2-6.

However, to access the blister packs (54) and (58) of the package (2), a user must first open the package (2) by unfolding the panels (4), (12), (10), and (8), and then applying pressure to the appropriate blister to force the article through the back of the corresponding panel. The Mellon package (2) does not appear to teach a package that permits access to the blisters by applying pressure to the blister via an outer or first panel so as to force the article contained in the blister out a second panel that opposes the first panel with the blister being disposed therebetween.

U.S. Pat. No. 7,000,768 to Morita et al. teaches a case for a press-through package (e.g., blister pack) having a first sheet member (1) that has an accommodation-hole forming section with plural accommodation holes (4) and a second sheet member (9) with take-out holes (11) corresponding to the accommodation holes (4). A press-through package (PTP) is placed between the first and second sheet members so that when first sheet member (1) is folded onto the second sheet member (9), one or more articles (e.g., pills) can be taken out from the blister pack through the take-out holes (11). See FIG. 3. A blocking sheet member (18) extends from the first end of the second sheet member (9) and folds so as to be placed between the second sheet member (9) and the press-through package or blister pack (PTP) when folded. The blocking sheet member (18) has plural holes (23) that initially do not match in position to the accommodation holes (4) and take-out holes (11). This ensures that the pills are securely blocked by the blocking sheet member (18) from being taken out of the press-through package (PTP). The blocking sheet member (18) can then be torn from the connection strip (20) and slid until the holes (23) are matched in position to the take-out holes (11) so that the pills can be removed from the case of the press-through package (PTP) by applying pressure to a corresponding blister that is protruding through the top panel. See FIGS. 1-2.

United States Patent Application Publication Number 2007/0235367 to Initini teaches a tamper-evident child resistant package (10) suitable for pharmaceuticals having a front sheet (14) with a plurality of apertures (24) defined therein, a rear sheet (28) having a plurality of tear strips (44) defined therein, the front sheet (14) and the rear sheet (28) being secured together about a portion of their periphery with the apertures (24) and tear strips (44) being in registry with each other. See FIG. 3. A blister pack (48) is mounted intermediate the front sheet (14) and rear sheet (28) that is slidable between a first position wherein the blister pockets are aligned with the apertures (24) of the front sheet (14) and a second position wherein the blister pockets are not aligned with the apertures (24) of the front sheet (14). When in the aligned position, the user can access the pharmaceuticals by applying the needed pressure to the blister to force the article through the rear sheet (28), and when in the non-aligned position, the pharmaceuticals cannot be accessed. See FIGS. 4-7.

However, Morita does not appear to disclose the first sheet member (1) and the blocking sheet member (18) that are folded over the second sheet member (9) being on the same side relative to the second sheet member (9). Rather, the first sheet member (1) and the blocking sheet member (18) are both folded over the second sheet member (9) and are on neighboring sides relative to the second sheet member (9). Moreover, the holes (23) of the blocking sheet (18) and the take-out holes (11) of the second sheet (9) are not aligned, thereby requiring a rather costly and complicated mechanism, i.e., the corrugated sheet (22) of the blocking panel (18) and the cuts (7) and cover (8) in the elongated hole (6) of the first sheet member (1), to manipulate the blocking sheet (18) so that the contents of the package can be accessed that would appear to be difficult for senior citizens to access.

United States Patent Application Publication Number 2005/0173291 to Specker et al. (Specker) discloses a package having a rectangular base (2) connected to an insert cover (4) by wall section (3) on one side and first and second panels (20) and (21) connected to the base (2) on the other side by side wall section (12). See FIG. 1. Apertures (36) formed in the base (2) are temporarily closed by members (16). Openings (24) and (25) are defined in the panels (21) and (20), respectively, wherein the openings (25) are sealed via perforated lines by a guarantee section (26) therein. A blister package is inserted between the two panels (20) and (21) such that the blisters extend through the openings (24) of the panel (21). When the panel (21) is folded over panel (20), their respective openings (24 and 25) are aligned with each other. To access the contents of the blister, the panels (20) and (21) are folded out of the packaging, the guarantee section (26) is torn away, and then the contents are forced from the blister by applying pressure thereto.

U.S. Pat. No. 5,339,960 to Price discloses a package (10) formed from a blank (23) having panels (A, B, and C) separated from each other by score lines (26 and 27). The package (10) includes a bubble chamber (12) bonded to a rupturable barrier (19) to hold a product or tablet (13) therein. A blister pack (37) containing at least one bubble chamber (12) is placed on top of the center panel (B) wherein the bubble chamber (12) extends through oval slots (36) formed in the panel (B). Panel (C) is then folded over score line (27) onto the center panel (B) and placed in direct contact with a backing layer (62) of the rupturable barrier (19), and then panel (A) is folded over score line (26) directly onto the panel (C) to complete assembly of the package (10). Panel (C) is heat sealed to the rupturable barrier (19) and the panel (A) is heat sealed to panel (C).

The panel (A) includes score lines (18) that define an access panel (17) aligned over the bubble chamber (12) and that may be peeled away along the score lines (18). The panel (C) includes score lines (48) that define a bendable breakaway panel (21) that is also aligned with the bubble chamber (12). When the access panel (17) is peeled up and away from the panel (A), an access opening is defined exposing the breakaway panel (21), which remains in an intact state. By pushing against the bubble chamber (12), the tablet (13) is forced against the rupturable barrier (19) until the rupturable barrier (19) ruptures and the breakaway panel (21) breaks away to expose the table (13) through the access opening.

However, the afore-mentioned related art does not appear to provide a mechanism for applying a substantially uniform pressure to a blister so as to expedite removal of an article being retained by the blister.

SUMMARY OF THE INVENTION

It is an aspect of this invention to at least overcome the above-discussed drawbacks of conventional child-resistant packages and dispensers.

Another aspect of this invention provides a unique child-resistant blister package that is child resistant and yet is senior citizen friendly.

Yet another aspect of this invention provides a multi-layered child resistant blister package formed by a plurality of panels separated from each other by fold lines. A first panel includes a plurality of first apertures defined therein, the first apertures may be covered by a, preferably translucent, biasable material. A plurality of radially extending channels or spokes may also extend from the first apertures. The first apertures are disposed opposite corresponding second and third apertures, respectively, defined in neighboring second and third panels.

According to another aspect of this invention, the radially extending channels or spokes assist a user in applying a substantially evenly distributed pressure to a blister for removal of a product from the blister package.

According to yet another aspect of this invention, the preferably translucent, biasable material spans and/or covers the first apertures to restrict direct access to a blister.

Additional panels may also be provided that contains indicia that would be ornamental and/or informative in nature.

BRIEF DESCRIPTION OF THE DRAWINGS

Other aspects and features of this invention will be better understood from the following description, with reference to the accompanying drawings, wherein.

DETAILED DESCRIPTION OF THE PREFERRED EMBODIMENTS

Figure 1A:
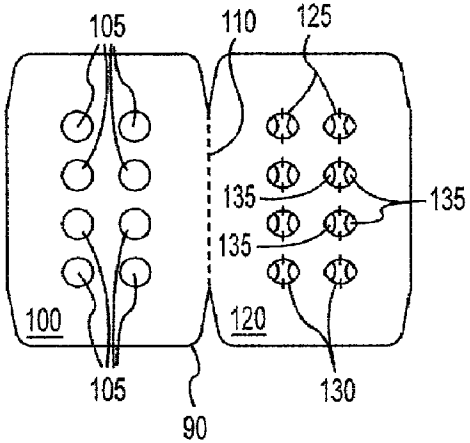
FIG. 1A is a top view of a retainer that is incorporated into the assembled package of FIG. 1 in another embodiment of the invention.
Figure 1:
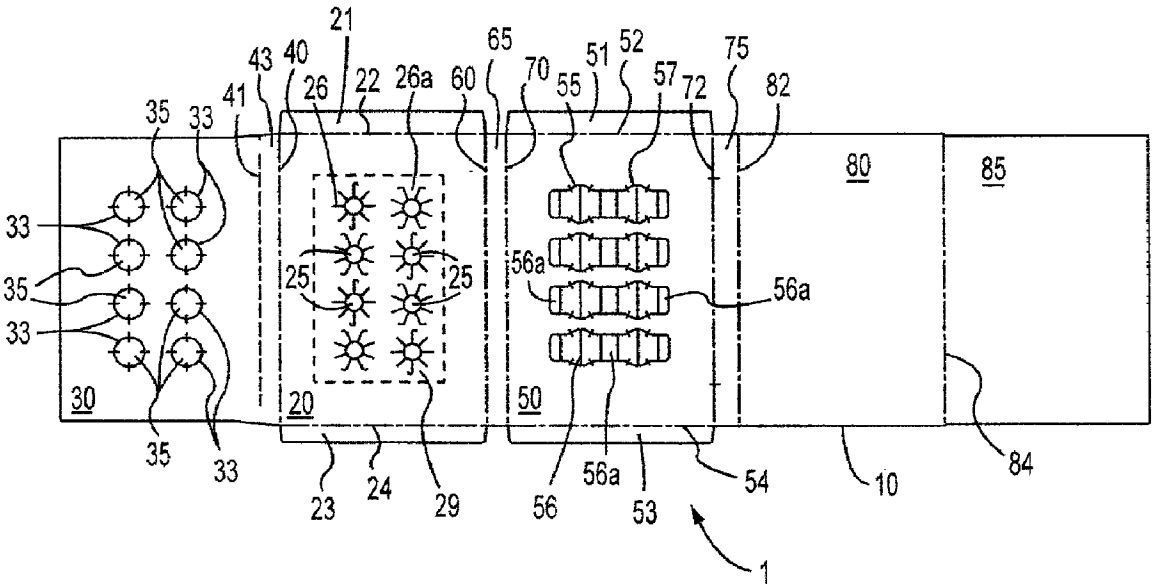
FIG. 1 is a top view of a disassembled package according to a preferred embodiment of the invention.

Referring to FIG. 1, the package 1 is formed from a flat, substantially rectangular-shaped blank 10, ideally made from paperboard, plastic, or a combination of paperboard and plastic. However, it is within the scope of this invention to use any suitable material, well known or later developed, such as, for example, paper, metal, natural or man-made materials, and the like. Furthermore, although not illustrated but well understood in the art, it is within the scope of this invention to use any suitable geometric shape, such as, for example, square, trapezoidal, circular, oval, and the like to form the package 1. Moreover, it is within the scope of the invention for the blank 10 to be composed of multiple pieces, or at least two, rather than the single piece described herein. Alternatively, the package 1 may further include an inner piece 90 that is contained within the package 1 formed by the blank 10 in a manner described in further detail below.

According to a preferred embodiment of the present invention, which is illustrated in FIGS. 1-7, the package 1 includes a first panel 20 separated on a first side from a second panel 30 by a fold line 40. The first panel 20 is separated on a second side, which is opposite the first side, from a third panel 50 by a fold line 60. First and second flaps 21 and 23, respectively, are separated from the first panel 20 by fold lines 22 and 24, respectively. The first and second flaps 21 and 23 oppose each other and can be orthogonally situated relative to the fold lines 40 and 60.

At least one, and preferably a plurality, of first apertures 25 are provided in a central region of the first panel 20. Each aperture 25 is defined by an opening having a plurality of channels or spokes 26 formed in the first panel 20 and which extend radially away from the first aperture 25. Neighboring spokes 26 define a trapezoidal shaped spring leg 26*a* therebetween such that a plurality of legs 26*a* ring or encompass each aperture 25.

Although two rows of four apertures 25 are shown being positioned relatively in the center of the first panel 20, it is within the scope of this invention to place any number of apertures 25, anywhere on the first panel 20 so long as the location is remote from the outer perimeter of the first panel 20, i.e., not bordering any portion of the perimeter of the first panel 20 and in as many rows, e.g., three or more, or little, i.e., only one row, as necessary. For example only, there could be one row, or three or more rows of any number of apertures 25 provided on the first panel 20.

It should be noted that while the first apertures 25 are illustrated as being circular in nature, it is within the scope of the invention for the apertures 25 to have any suitable geometric configuration, such as oval, rectangular, square, triangular, pentagon, octagon, hexagon and the like.

Figure 5:
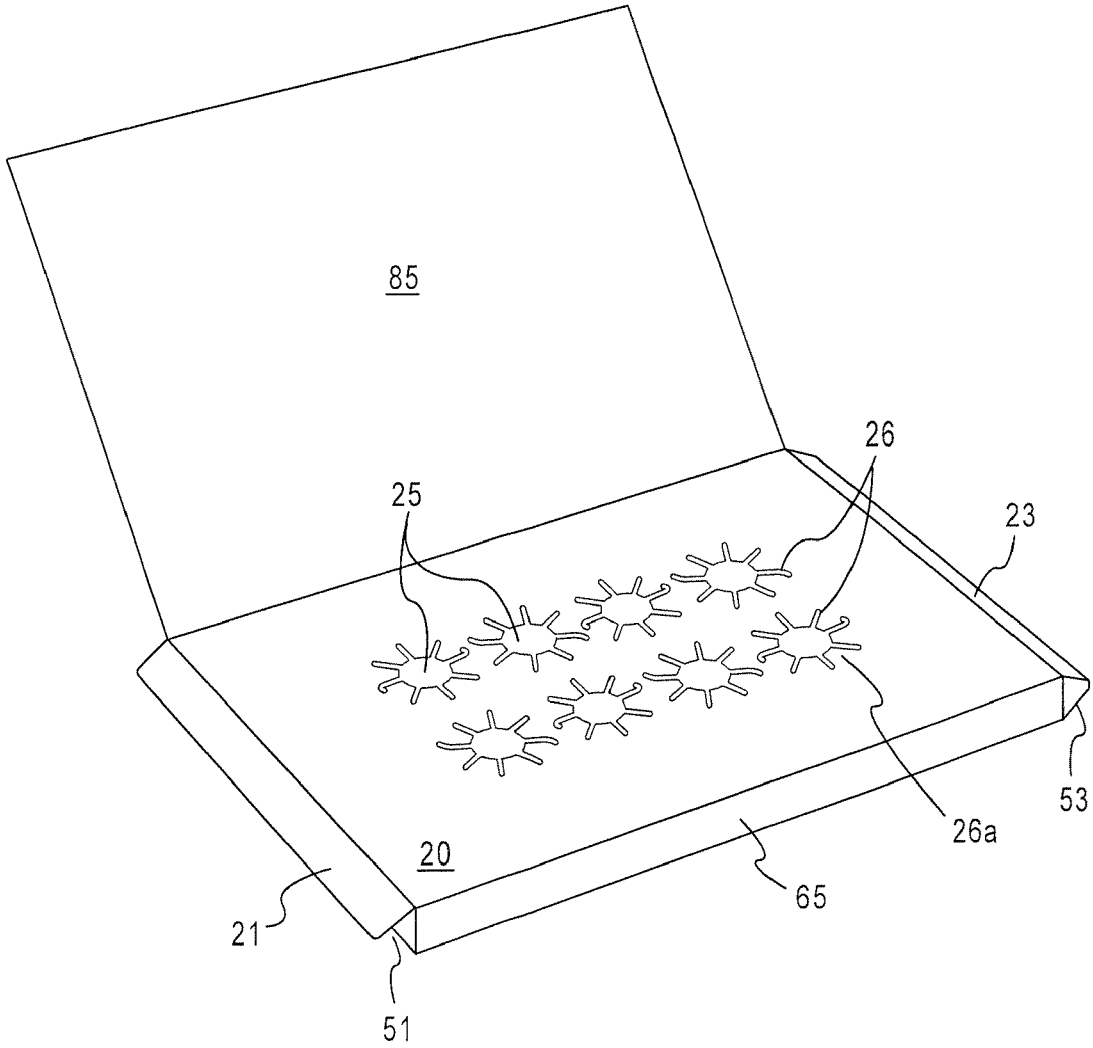
FIG. 5 is a perspective view of the package in a more fully assembled state.

Moreover, while the plurality of channels or spokes 26 are illustrated in FIGS. 1 and 5 as extending radially in a substantially straight line away from each first aperture 25, it is within the scope of the invention for the spokes 26 to have any suitable geometric configuration, such as sinusoidal, square wave, jagged, curved, and the like.

A shield 29, which is formed from a preferably transparent, biasable material, is attached to the first panel 20 to span or cover the openings of the aperture 25 and spokes 26. It should be noted that the term bias able used herein is intended to mean a material that is flexible or at least more flexible than rigid such that a user may impart a force to the material that can be translated by the material to a biasing force that is transferred and applied to another material or object on a side of the material that is opposite the side to which the user force is applied. As shown in FIG. 1, the shield 29 is configured to span or cover all of the apertures 25 and spokes 26 formed in the first panel 20. While the shield 29 is illustrated as being a single piece, it is within the scope of the invention to comprise a plurality of pieces so long as each aperture 25 and spoke 26 is covered by the shield 29. Moreover, the shield 29 serves to prevent access to blisters in a blister pack that is incorporated with the package 1. Furthermore, the shield 29 prevents the blisters from protruding through the apertures 25 and protects the blisters from undesired access as well as damage. Also, because the shield 29 is formed from a bias able or flexible material, the shield 29 transmits a biasing force to the blister when the user applies a force to a corresponding portion of the shield 29 that spans a corresponding aperture 25.

A plurality of second apertures 35 are formed in the second panel 30, the apertures 35 being defined by non-continuous cut lines 33. Although two rows of four apertures 35 are shown being positioned relatively in the center of the second panel 30, it is within the scope of this invention to place any number of apertures 35 anywhere on the second panel 30 so long as the number of apertures 35 corresponds to the number of apertures 25 formed in the first panel 20 and the location of the apertures 35 is remote from the outer perimeter of the second panel 30, i.e., not bordering any portion of the perimeter of the second panel 30 and in as many rows, e.g., three or more, or little, i.e., only one row, as necessary. For example only, there could be one row, or three or more rows of any number of apertures 35 provided on the second panel 30.

The second panel 30 is configured to coincide with the first panel 20 and the third panel 50. In an embodiment of the invention, a blister pack (not shown) may be attached to a surface of the second panel 30 so as to be intermediate the first and second panels 20 and 30. That is, while one surface of the second panel 30 would be attached to a surface of the third panel 50 in a manner where the second apertures 35 are in registered alignment with exit apertures 55 defined in the third panel 50, the blister pack would be placed on the other surface of the second panel 30 so as to extend toward or face the first panel 20 with the blisters in registered alignment with the apertures 25, 35 and 55 defined in the first, second and third panels 20, 30 and 50, respectively.

The blister pack is well known in the art and is made from such materials as, for example only, clear plastic, foil, or the like. It should be noted that blister pack is well known in the art and includes a backing that may include, but does not require, a rupturable membrane through which each article must pass when being removed from the package 1.

The third panel 50 is separated from the second panel 20 by a spine 65 defined by the fold line 60 of the first panel 20 and a fold line 70 of the third panel 50. The spine 65 is formed in a manner that will be described in further detail later. The third panel 50 includes a plurality of third or exit apertures 55 configured to coincide with the first and second apertures 25 and 35 of the first and second panels 20 and 30, respectively, when the package 1 is assembled. The exit apertures 55 are defined by tear way panels 56 bounded by windows 56*a* on both sides thereof. The windows 56*a* are sized to permit the user to insert an object therein, such as, for example, a fingernail or pencil tip, to remove the tear way panel 56 so as to maximize the open area of the aperture 55. As such, the aperture 55 can be formed in the third panel 50, either by removing the tear away panels 56, which are defined by non-continuous cut lines 57, or by the article contained in the blister pack rupturing a corresponding panel 56 and passing therethrough.

The number of exit apertures 55 should correspond to the number of first apertures 25 in the first panel 20 and second apertures 35 in the second panel 30. However, it is within the scope of the invention to have a number of exit apertures 55 that may be less than a number of the first and second apertures 25 and 35, respectively, such that multiple, i.e., at least two, articles may pass through a single exit aperture 55. In other words, it is within the scope of this invention for the exit apertures 55 to be sized to permit multiple articles to pass therethrough.

Third and fourth flaps 51 and 53, respectively, are separated from the third panel 50 by fold lines 52 and 54, respectively. The third and fourth flaps 51 and 53 oppose each other and can be orthogonally situated relative to the fold line 70.

Although not necessary, the package 1 may also include at least one of fourth and fifth panels 80 and 85 provided on the side of the third panel 50 opposing the side adjacent the first panel 20. The fourth panel 80 would be separated from the third panel 50 by a fold line 72 formed on an edge of the third panel 50 and a fold line 82 formed on an edge of the fourth panel 80. A spine 75 is formed by the fold lines 72 and 82 in a manner that will be described in further detail below.

A fold line 84 separates the fourth panel 80 from the fifth panel 85. The fourth and fifth panels 80 and 85 could be included in the package 1 to provide indicia or other suitable graphic information thereon.

Figure 2:
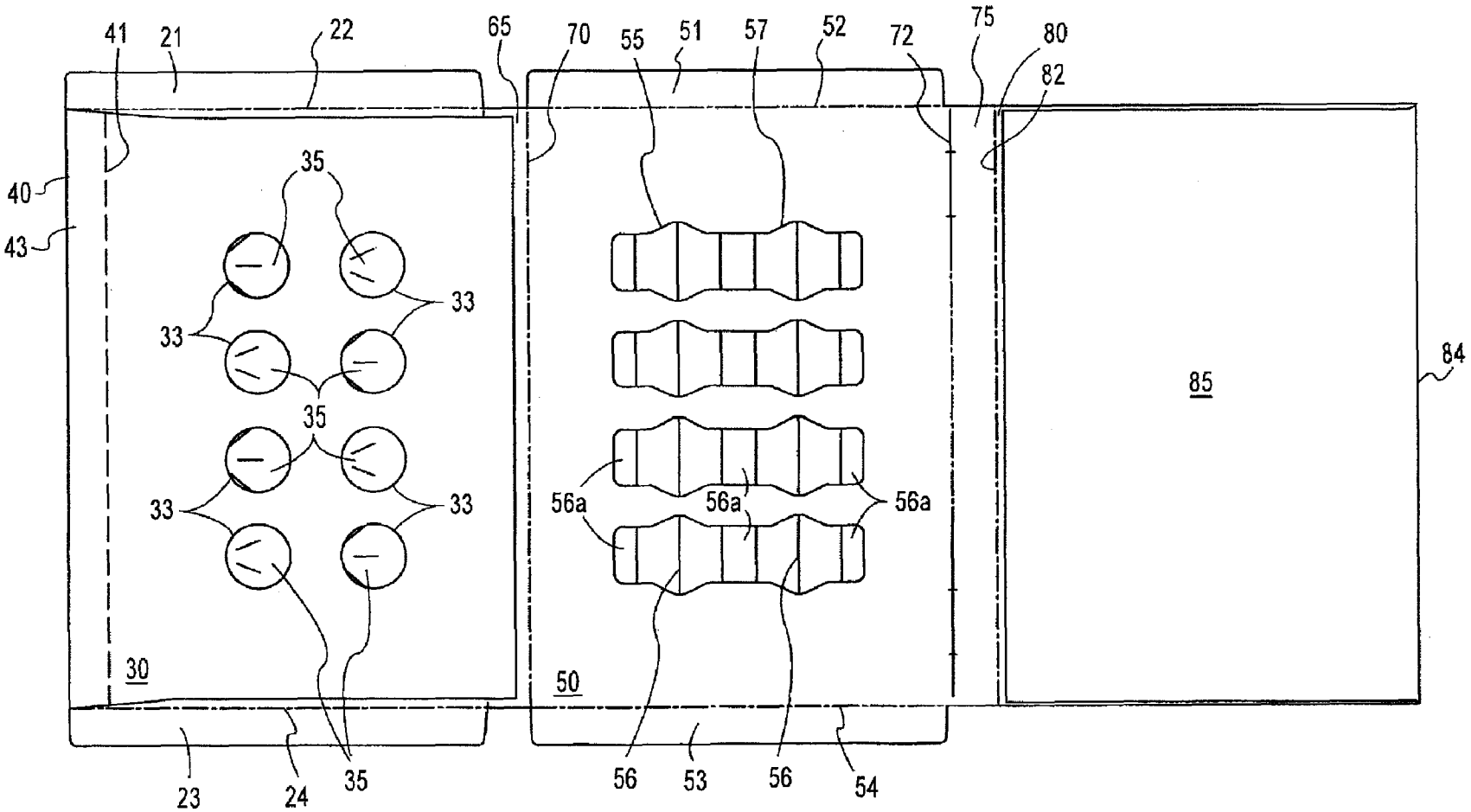
FIG. 2 is a top view showing the package of FIG. 1 in a partially assembled state.

To assemble the package 1, a blister pack (not shown) is affixed to the surface of the second panel 30 facing the observer in FIG. 1 such that each blister is aligned with a corresponding second aperture 35, wherein the back of the blister pack is attached or adhered to the second panel 30 with the blisters containing articles therein facing away from the surface of the second panel 30. As such, when the second panel 30 is folded over a crease 41 defined therein and then folded over the fold line 40 to form a spine 43 between the first and second panels 20 and 30, the blisters will be disposed intermediate the first and second panels 20 and 30, and in alignment with the apertures 25 and 35. If provided, the fifth panel 85 is folded over the fold line 84 onto the fourth panel 80 (FIG. 2).

Figure 3:
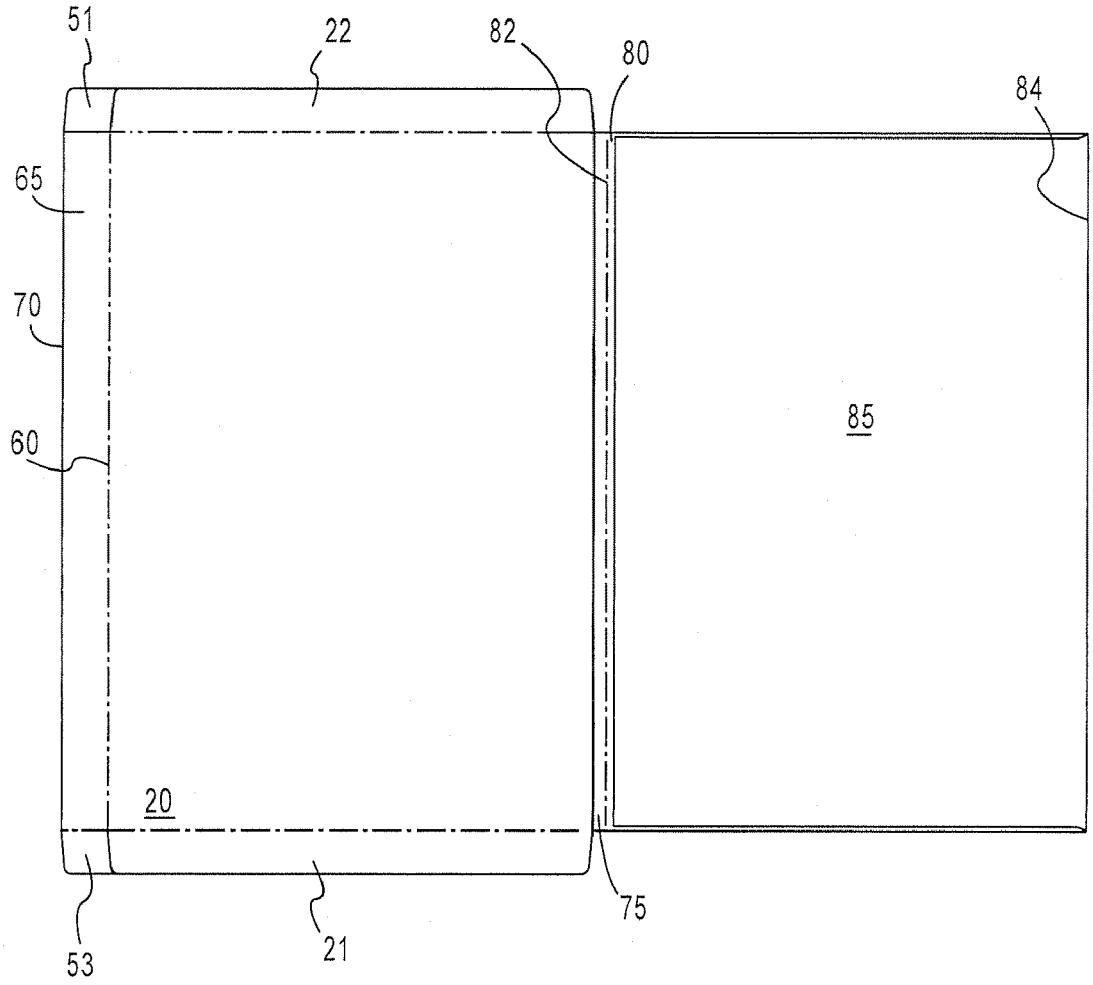
FIG. 3 is a top view of the package of FIG. 2 in a further assembled state.
Figure 4:
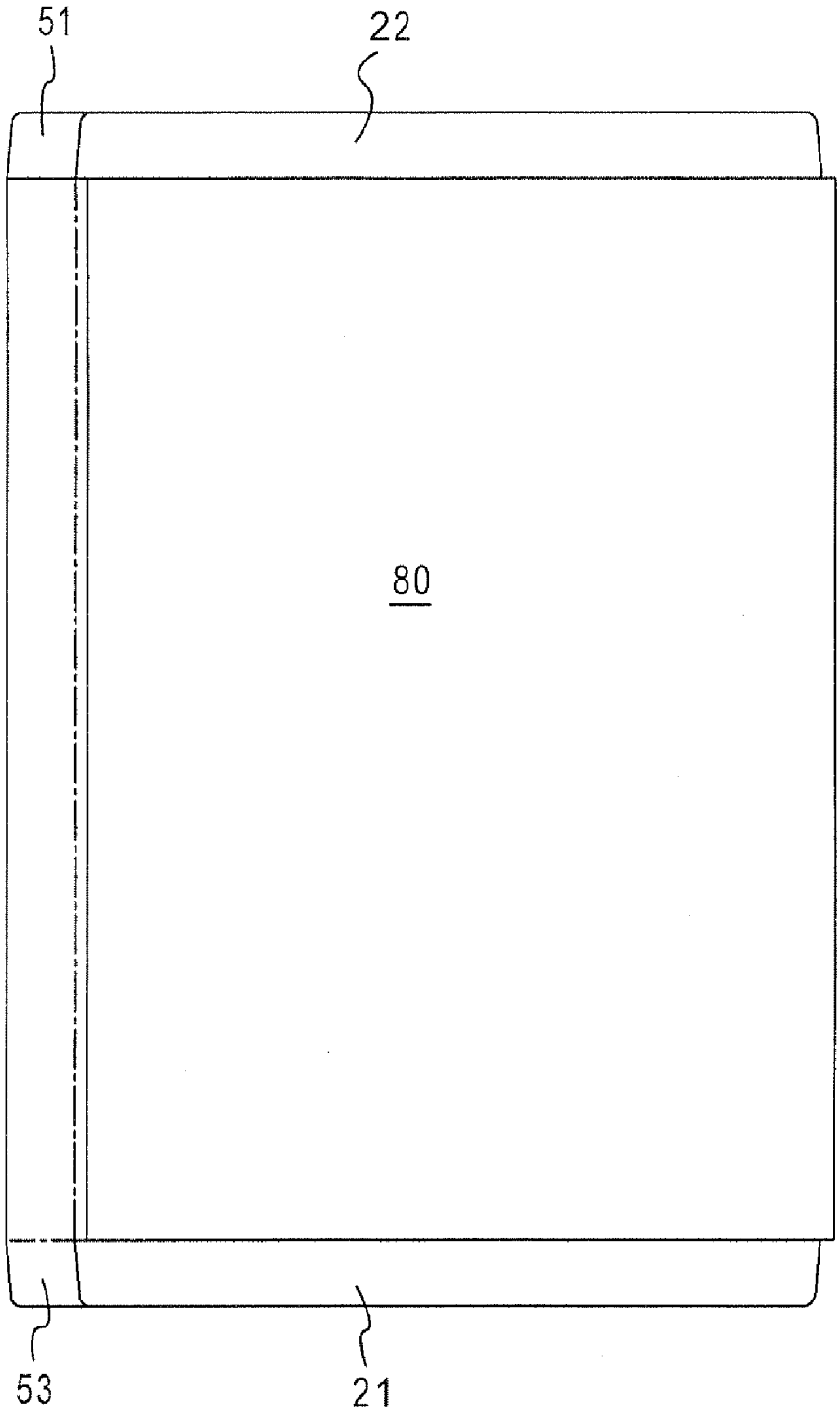
FIG. 4 is a top view of the package of FIG. 3 in a more further assembled state.

The first panel 20, blister pack, and second panel 30 assembly is folded over fold line 60 (FIG. 3). The first panel 20, blister pack and third panel 30 assembly is then folded over fold line 70, which forms the spine 65 and places the first panel 20, blister pack, and second panel 30 assembly in an essentially parallel relationship with the third panel 50 (FIG. 4). Moreover, the first panel 20, blister pack, and second panel 30 assembly, along with the third panel 50, are arranged in a substantially orthogonal relationship relative to the spine 65. Also, the blisters of the blister pack and the apertures 25, 35 and 55 of the first, second and third panels 20, 30 and 50, respectively, are in registered alignment with each other.

The first and second flaps 21 and 23 are folded over their respective fold lines 22 and 24. Then, the third and fourth flaps 51 and 53 are folded over their respective folds lines 52 and 54, and onto the first and second flaps 21 and 23. The third and fourth flaps 51 and 53 are then adhered to the first and second flaps 21 and 23 so as to enclose the open ends of the package 1 (FIG. 5). Alternatively, the third and fourth flaps 51 and 53 may be folded first, with the first and second flaps 21 and 23 being folded subsequent thereto, such that the first and second flaps 21 and 23 are adhered to the third and fourth flaps 51 and 53 to enclose the open ends of the package 1.

If provided, the fourth and fifth panels 80 and 84 are then folded over the fold line 82, and then folded over the fold line 72 to form the spine 75 wherein the spine 75 overlays the spine 43. The spine 75 is then adhered to the spine 43 to complete the process of assembling the package 1.

In another embodiment of the invention, a retainer 90 (FIG. 1A) is provided that secures the blister pack therein instead of attaching the blister pack to the second panel 30 in the manner described above (FIG. 1). The retainer 90 includes a front panel 100 separated from a back panel 120 by fold line 110. The front panel 100 includes a plurality of apertures 105 configured to permit the blister of the blister pack to protrude therethrough. The back panel 120 includes a plurality of apertures 125 defined therein. The apertures 125 of the back panel 120 may include a door 130 that either partially or completely spans the opening of the aperture 125. The exemplary embodiment shown in FIG. 1A includes a door 130 that partially spans the opening, wherein at least one and preferably two windows 135 bound the door 130. However, it is within the scope of the invention for the door 130 to completely span the aperture 125.

A back surface of the blister pack is attached to the back panel 120 wherein the blisters are in registered alignment with the apertures 125. The front panel 110 is then folded over fold line 110 and onto a front surface of the blister pack such that the blisters of the blister pack protrude through a corresponding aperture 105. The assembly of the retainer 90, with the blister pack securely retained therein, is configured so that when the retainer 90, with the blister pack retained therein, is inserted into the package 1, the blisters are in registered alignment with the apertures 25, 35 and 55 of the first, second and third panels 25, 35 and 55, respectively, and wherein the blisters are intermediate the apertures 25 of the first panel and at least one of the apertures of the second and third panels 35 and 55, respectively.

Figure 6:
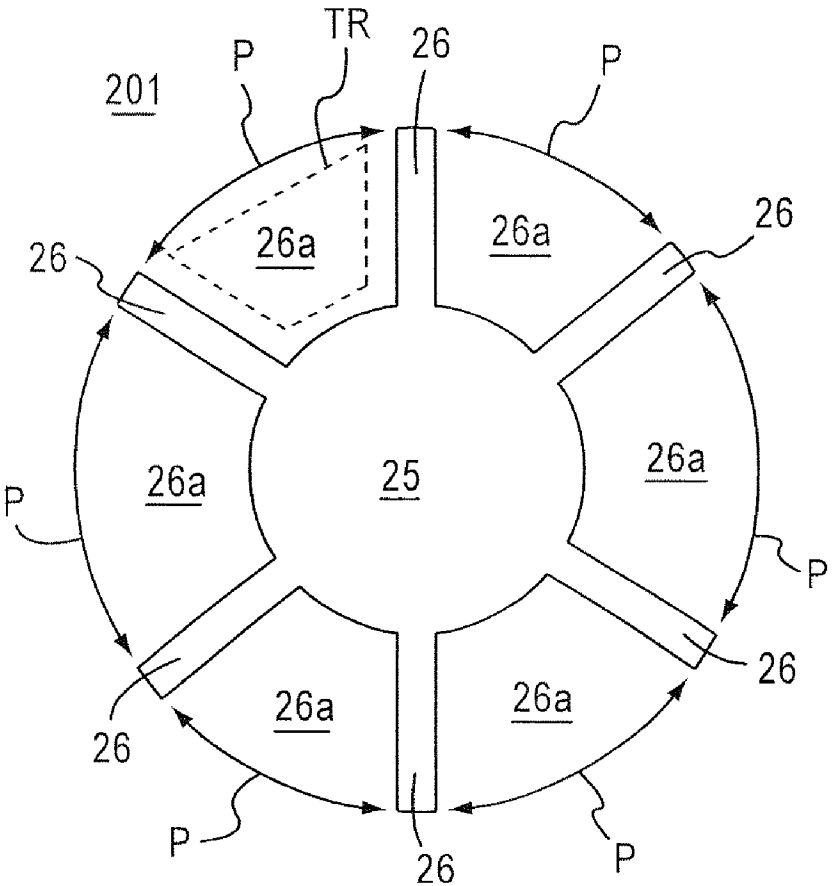
FIG. 6 is an enlarged view of an aperture formed in the first panel of the inventive package.

FIG. 6 is an enlarged view of an exemplary embodiment of the aperture 25 according to the present invention. In the illustrated example, the spokes 26 formed in the first panel 20 and radiating away from the aperture 25 are shown as being straight merely to facilitate understanding. However, as described above, the spokes 26 may have any suitable geometric configuration, such as sinusoidal, square wave, jagged, curved, and the like. Neighboring spokes 26, 26 shown in FIG. 6 define a trapezoidal shaped spring leg 26*a* therebetween, which is identified by the dashed line TR. It should be understand that different shaped spokes 26 may produce a correspondingly different shaped spring leg 26*a*. A pivot line P is defined by the base of the spring leg 26*a*.

Figure 7:
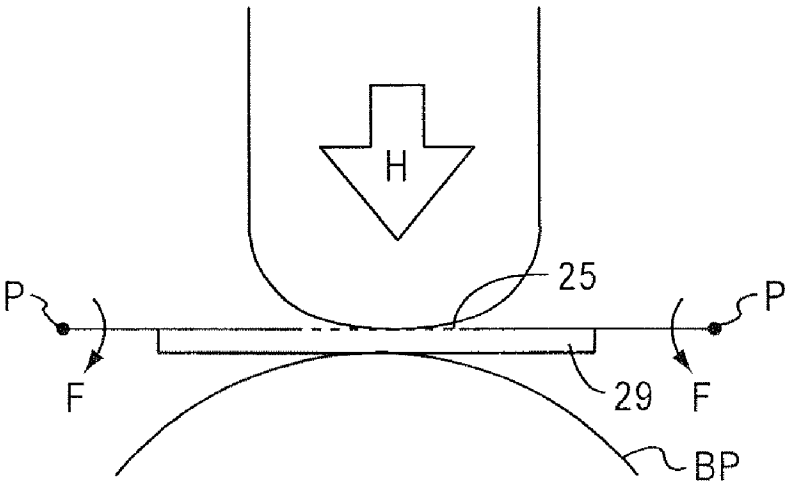
FIG. 7 is a schematic diagram of a cross-section view of a force being applied to a blister pocket via a spring leg and shield.

FIG. 7 is a schematic diagram of a cross-section view illustrating how a blister BP is depressed by a finger, for example, and a spring leg 26*a*. A portion of the shield 29 provided between an inner surface of the first panel 20 and the blister BP is illustrated as well.

In use or operation, a person applies a force H to the blister BP by, for example, placing their finger on an area over the blister BP having the portion of the shield 29 spanning the aperture 25 and including at least a part of the spring leg 26*a*. Ideally, but not required, the finger would be centered over the aperture 25 such that each of the spring legs 26*a* are included in the area upon which the finger is placed.

Preferably, a first portion of the force H is applied to the blister BP via the portion of the shield 29 that is directly contacting the blister BP. The spring legs 26*a* defined by the spokes 26 formed in the first panel 20 provide a biasing force F about the pivot line P. As such, a second portion of the force H is applied to the blister BP via the spring leg 26*a* wherein the biasing force F about the pivot line P amplifies the second portion of the force H applied to the blister BP via a portion of the shield 29. As such, an increased value of the force H is applied to the blister BP, making pushing of the article through the blister package and out the exit apertures 55 of the third panel 50. That is, the present invention makes it easier for an adult to access the articles being retained within the blister BP of the package 1.

Although the preferred embodiment of the invention is described above with a shield 29 being provided between the first panel 20 and the blister BP, it is also within the scope of the present invention for the package 1 not to include the shield 29 wherein the force H is applied directly to the blister BP by the finger contacting an exposed portion thereof in combination with the amplifying, biasing force conveyed by the spring legs 26*a*.

Figures 8, 8A:
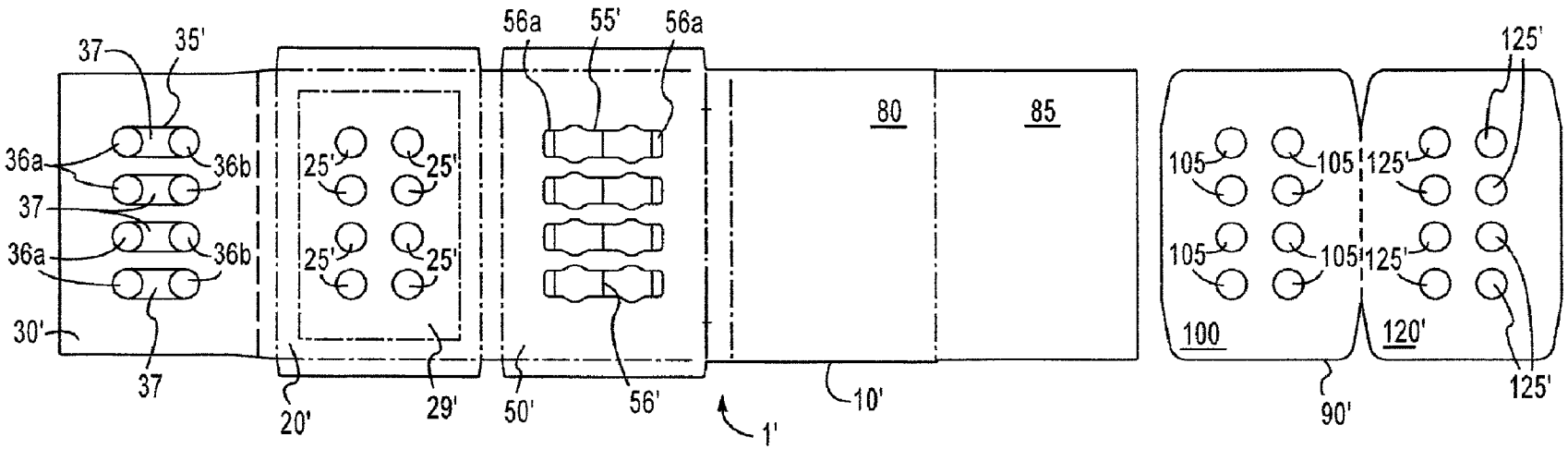
FIG. 8 is a top view of a disassembled package according to an alternate embodiment of the invention.
FIG. 8A is a top view of a retainer that is incorporated into the assembled package of FIG. 8 in another embodiment of the invention.

Moreover, although embodiments of the present invention have been discussed above that include the shield 29 and the spokes or channels 26 that form the spring legs 26*a*, or only the spokes or channels 26 with no shield 29, it is also within the scope of the present invention to provide an embodiment of the package 1' formed from a blank 10' that includes only the shield 29' without any spokes or channels 26 extending from the first apertures 25', as shown in the embodiment illustrated in FIG. 8. That is, the first panel 20' is provided with the shield 29' spanning the first apertures 25' without any spokes or channels extending from the apertures 25'. Accordingly, in this embodiment, the entire force H applied to the blister BP is transmitted via the shield 29' with no portion of the force H being transmitted to the blister BP via the spring legs 26*a* of which there are none.

Further, it is within the scope of the present invention for any of the embodiments described herein to provide second apertures 35' on the second panel 30', wherein the second apertures 35' are defined by the non-continuous cut lines 33 (see FIG. 1) and include a first sub-aperture 36*a* joined to a second sub-aperture 36*b* by a cut-out 37 disposed therebetween. The cut-out 37 is configured to receive therein a fingernail or implement that can be used to remove a corresponding portion of the second panel 30' by breaking the cut line 33 to form the corresponding sub-aperture 36*a* or 36*b*, or both sub-apertures 36*a* and 36*b*.

Also, it is within the scope of the present invention for any of the embodiments described herein to provide third apertures 55' defined by tear away panels 56' where only the opposing ends of the panels 56' are bounded by windows 56*a'* where there is no window 56*a'* disposed between the panels 56' such that the windows 56' abut each other.

Additionally, a retainer 90' (FIG. 8A) may be provided wherein the doors 130 and windows 135 from FIG. 1A are omitted from the apertures 125' of the back panel 120'.

The above described structural configurations of the package 1 (1') provide a package that is easy to use by adults yet prevents unwanted access to the articles therein by children.

Many modifications may be made to adapt the teachings of the package of this invention to particular situations or materials without departing from the scope thereof. Therefore, this invention should not be limited to the particular embodiments disclosed herein, but includes all embodiments within the spirit and scope of the disclosure.

What is claimed is:

1. A multi-layered blister package comprising:

a blister pocket;

a first panel having at least one first aperture defined therein, the blister pocket being visible through the at least one first aperture and retaining an article therein;

a second panel having at least one exit aperture defined therein by a first non-continuous cut line, wherein the at least one exit aperture aligns with the at least one first aperture when the first panel is disposed over the second panel;

a first fold line separating the first panel from the second panel; and a biasing force transmitting member provided with the first panel, wherein the biasing force transmitting member comprises a plurality of spring legs encompassing the at least one first aperture, a biasing force being applied to the blister pocket via the biasing force transmitting member, each spring leg being formed by a pair of spokes and a pivot line, each spoke extending radially away from the at least one first aperture and terminating at the pivot line, which connects termination points of each spoke.

2. The package according to claim 1, wherein each spoke is configured to have a shape that is either straight, sinusoidal, square wave, jagged and curved.

3. The package according to claim 1, wherein the at least one first aperture is configured to have a shape that is either circular, oval, rectangular, square, triangular, pentagon, octagon and hexagon.

4. The package according to claim 1, wherein each spring leg is substantially trapezoidal in shape, with the pivot line defining a base of the trapezoidal shape.

5. The package according to claim 1, further comprising a retainer, the retainer including opposing third and fourth panels, wherein the blister pocket is affixed to the third panel and protrudes through a corresponding at least one retainer aperture defined therein.

6. The package according to claim 5, wherein the third panel is separated from the fourth panel by a second fold line.

7. The package according to claim 1, wherein the biasing force transmitting member further comprises a shield member disposed between the first panel and the blister pocket.

8. The package according to claim 7, wherein the shield member spans an area that includes the at least one first aperture and extends beyond the pivot line.

9. The package according to claim 7, wherein each spoke is configured to have a shape that is either one of straight, sinusoidal, square wave, jagged or curved.

10. The package according to claim 7, wherein the at least one first aperture is configured to have a shape that is either one of circular, oval, rectangular, square, triangular, pentagon, octagon or hexagon.

11. The package according to claim 7, further comprising a retainer, the retainer including opposing third and fourth panels, wherein the blister pocket is affixed to the third panel and protrudes through a corresponding at least one retainer aperture defined therein.

12. The package according to claim 11, wherein the third panel is separated from the fourth panel by a second fold line.

13. A multi-layered blister package comprising:

a blister pocket;

a first panel having at least one first aperture defined therein, the blister pocket being visible through the at least one first aperture and retaining an article therein;

a second panel having at least one exit aperture defined therein by a first non-continuous cut line, wherein the at least one exit aperture aligns with the at least one first aperture when the first panel is disposed over the second panel;

a first fold line separating the first panel from the second panel; and a biasing force transmitting member provided with the first panel, wherein the biasing force transmitting member comprises a plurality of spring legs encompassing the at least one first aperture, a biasing force being applied to the blister pocket via the biasing force transmitting member, each spring leg being formed by a pair of spokes and a pivot line, each spoke extending radially away from the at least one first aperture and terminating at the pivot line, which connects termination points of each spoke; and a shield member disposed between the plurality of spring legs encompassing the at least one first aperture of the first panel and the blister pocket.

14. The package according to claim 13, wherein the shield member spans an area that includes the at least one first aperture and extends beyond the pivot line.

15. The package according to claim 13, wherein each spoke is configured to have a shape that is either straight, sinusoidal, square wave, jagged and curved.

16. The package according to claim 13, wherein the at least one first aperture is configured to have a shape that is either circular, oval, rectangular, square, triangular, pentagon, octagon and hexagon.

17. The package according to claim 13, wherein each spring leg is substantially trapezoidal in shape, with the pivot line defining a base of the trapezoidal shape.

18. The package according to claim 13, further comprising a retainer, the retainer including opposing third and fourth panels, wherein the blister pocket is affixed to the third panel and protrudes through a corresponding at least one retainer aperture defined therein.

19. The package according to claim 13, wherein the blister pocket is affixed to the second panel.

* * * * *